US009183819B2

(12) United States Patent
Hollander

(10) Patent No.: US 9,183,819 B2
(45) Date of Patent: Nov. 10, 2015

(54) SLEEVE FOR A FRETTED MUSICAL INSTRUMENT

(71) Applicant: David Hollander, Wilton, CT (US)

(72) Inventor: David Hollander, Wilton, CT (US)

( * ) Notice: Subject to any disclaimer, the term of this patent is extended or adjusted under 35 U.S.C. 154(b) by 0 days.

(21) Appl. No.: 14/419,090

(22) PCT Filed: Aug. 2, 2013

(86) PCT No.: PCT/US2013/053496
§ 371 (c)(1),
(2) Date: Feb. 2, 2015

(87) PCT Pub. No.: WO2014/022814
PCT Pub. Date: Feb. 6, 2014

(65) Prior Publication Data

US 2015/0221293 A1 Aug. 6, 2015

Related U.S. Application Data

(60) Provisional application No. 61/679,403, filed on Aug. 3, 2012.

(51) Int. Cl.
*G10G 7/00* (2006.01)

(52) U.S. Cl.
CPC ..... *G10G 7/005* (2013.01)

(58) Field of Classification Search
CPC ..... G10G 5/00; G10G 7/005; F16M 13/00; A45C 13/002; A45C 9/00
USPC ..... 84/453, 327, 329, 421
See application file for complete search history.

(56) References Cited

U.S. PATENT DOCUMENTS

| | | | |
|---|---|---|---|
| 3,407,700 | A | 10/1968 | Hollander |
| 3,877,501 | A | 4/1975 | Toth |
| 4,000,678 | A | 1/1977 | Messina |
| 4,177,847 | A | 12/1979 | Spindler |
| 4,649,793 | A | 3/1987 | Blackshear et al. |
| 4,738,180 | A | 4/1988 | McKnight |
| 5,289,751 | A | 3/1994 | Light |
| 5,725,094 | A | 3/1998 | Moral |
| 5,920,022 | A | 7/1999 | Ashwood, Jr. |
| 5,936,178 | A | 8/1999 | Saari |

(Continued)

OTHER PUBLICATIONS

How to Use the Dampit. Dampits, Inc., Jan. 27, 2010. (retrieved on Dec. 18, 2013). Retrieved from the Internet: http://web.archive.org/web/201001271842/http://www.dampits.com.howtouse.html, 1 page.

(Continued)

*Primary Examiner* — Kimberly Lockett
(74) *Attorney, Agent, or Firm* — Ohlandt, Greeley, Ruggiero & Perle, L.L.P.

(57) ABSTRACT

A removable sleeve that encloses and protects the neck of a fretted musical instrument is provided. The bottom edge of the sleeve can be tightened about the neck of the fretted musical instrument with a closure to form a discrete environment inside the sleeve. The sleeve has one or more chutes on the inside of the sleeve into which a humidifying device can be inserted to impart and regulate the humidity level inside the sleeve. The control of humidity prevents damage to the neck of the musical instrument, such as cracking or warping, as well as loosening of the frets. A method for using the sleeve to protect and to control humidity levels around the neck of a fretted musical instrument or of other wood structures is also provided.

24 Claims, 7 Drawing Sheets

(56) References Cited

U.S. PATENT DOCUMENTS

| | | | |
|---|---|---|---|
| 6,054,642 | A | 4/2000 | Brooks |
| 6,133,519 | A | 10/2000 | Mair |
| 6,441,288 | B1 | 8/2002 | Lin |
| 6,759,582 | B2 | 7/2004 | Rouston |
| 6,959,810 | B2 | 11/2005 | Neilson |
| 7,238,870 | B2 | 7/2007 | Stewart |
| 7,291,778 | B2 | 11/2007 | Larry |
| 7,453,034 | B2 | 11/2008 | Johnson |
| 7,462,769 | B2 | 12/2008 | Kilpatrick |
| 7,671,264 | B1 | 3/2010 | Heda |
| 7,956,270 | B1 | 6/2011 | Burmeister et al. |
| 2002/0070129 | A1 | 6/2002 | Tunstall-Behrens |
| 2002/0189423 | A1 | 12/2002 | Brantley |
| 2008/0047637 | A1 * | 2/2008 | Mosier ..... 150/154 |
| 2011/0203953 | A1 | 8/2011 | Fowler, II |

OTHER PUBLICATIONS

International Search Report dated Jan. 10, 2014 from PCT/US2013/053496, 3 pages.

Written Opinion Report dated Jan. 10, 2014 from PCT/US2013/053496, 12 pages.

International Report on Patentability dated Feb. 12, 2015 from PCT/US2013/053496, 10 pages.

* cited by examiner

SLEEVE FOR A FRETTED MUSICAL INSTRUMENT

BACKGROUND OF THE DISCLOSURE

1. Field of Disclosure

This disclosure relates to a removable sleeve with a chute secured inside that holds a humidifying device to enclose, protect and impart/control humidity about the neck of a fretted musical instrument.

2. Description of Related Art

The stock and neck of a fretted musical instrument, such as a guitar, ukulele, sitar, lute, banjo, mandolin, and electric guitar, are generally made of wood. The neck has a flat surface, sometimes called a fingerboard, into which small pieces of metal wire, formed as frets, are partially embedded, so that a portion of each fret (also called "frett" in this application) protrudes above the fingerboard at intervals corresponding to the notes of the chromatic scale. One or more vibrating strings fixed at two end points on the instrument and held under tension produce a musical sound that is transmitted by the musical instrument when the strings are struck or bowed by the player. By pressing a string down to the fingerboard, the player causes the string to contact a fret, shortening the length of the string that can vibrate when struck, and so can produce a variety of musical pitches.

While all wood musical instruments are affected to some degree by exposure to water vapor (also referred to as "humidity" or "moisture" in this application), those musical instruments that have "fretted" necks are particularly vulnerable to damage from exposure to extremes of humidity. Generally, high humidity causes the wood in the neck to expand, if it can; but if some portion of the neck is limited because it is braced by a supporting metal bar, or if the force from the vibrating strings held under tension is not uniform (because of different string thicknesses, for example), the wood in the neck may be unable to expand uniformly, and over time will cause the wood in the neck to warp. Conversely, when the ambient humidity is too low (i.e., too dry), the wood in the neck tends to contract, if it can; again, if there is some brace or exterior force on the neck that prevents the wood from contracting uniformly over a period of time, the result may be a neck that warps or cracks.

Fretted instruments have the additional problem that the wood in the neck can expand or contract at a different rate (and to a different extent) than the metal frets embedded in the neck. Over time, these different expansion/contraction rates may cause the frets to loosen, or separate from the wood fingerboard in which they are embedded. Loose frets can interfere with the pitch or quality of the sound, or cause the string to "buzz." Since frets are often made of a piece of metal alloy, and are sharp, a loose fret that extends out beyond the width of the fingerboard can cut the fingers of a player sliding a hand along the side of the neck as he or she plays. Repair of the neck and frets in such instances is inevitable and expensive. Obviously, this particular issue is not a problem for non-fretted instruments, such as the violin, cello, or (acoustic) bass.

While humidifying devices (for example, guitar and super guitar DAMPITS®) have long been recognized as valuable tools for protecting the hollow bodies of musical instruments, protecting the neck of a fretted musical instrument presents a different and challenging problem. Placing a humidifying device in the instrument's carrying case is generally not efficient to protect the neck of a fretted instrument, since the imparted humidity is not localized near the neck of the instrument, and much of the humidity from the humidifying device is absorbed in the padding of the case itself. In addition, conventional humidifying devices rely on a reservoir of water that is contained (in part, by gravity) at the bottom of the humidifying device in a portion that is free of pores or other holes that would otherwise allow water to leak out and possibly damage the instrument. And since the neck of the fretted instrument protrudes upwardly from the body of the instrument when the instrument is propped upright on a musical stand or in a carrying case, the structure of a conventional humidifying device may be oriented upside down when placed over the neck of the instrument, and so allow water to leak out where it might contact the neck, frets or strings, causing damage or rust that defeats its purpose. Also, as a practical matter, the neck of a fretted instrument does not have a hollow space into which a humidifying device can be suspended, as contrasted with the body of the instrument, which does.

SUMMARY OF THE DISCLOSURE

The present disclosure provides a removable protective sleeve that can be placed over the stock, neck and frets of a fretted musical instrument. The sleeve is sealed or folded along three of its sides, and has an unsealed fourth side that, when open, can receive the stock and neck of the instrument to completely enclose the stock and neck of the instrument but not the body of the instrument. The sleeve can be tightened about the base of the neck of the instrument by a closure device at the periphery of the unsealed side.

The protective sleeve has a chute that is secured to an interior aspect of the sleeve. The chute generally has a tubular shape or tunnel shape, and has an opening at one or both ends into which a humidifying device can be inserted. The chute has pores and is permeable to water vapor so that it can impart humidity in the closed environment around the neck of the instrument. The chute secures the humidifying device inside the protective sleeve in an orientation that does not permit water to leak out to damage the neck or frets.

The protective sleeve is water-impervious and at least partly impervious to water vapor. When placed over the stock and neck of a fretted musical instrument, the sleeve creates a discrete, enclosed environment in which humidity about the neck can be imparted and controlled by the humidifying device inside the sleeve, regardless of the ambient humidity of the room outside of the protective sleeve.

The present disclosure further includes a humidifying device that is inserted into the chute. The humidifying device has an exterior substrate that encloses a water-absorbent material, such as a sponge. The exterior substrate is perforated so that, prior to insertion in the sleeve, the humidifying device can be immersed in water that is absorbed by the sponge, and through which excess water is wrung out of the sponge.

The humidifying device can be selected to impart and maintain a predetermined amount of humidity selected for the particular type of fretted musical instrument.

The present disclosure further provides a method for using a protective sleeve and humidifying device to enclose, protect, and to impart humidity to, the stock, neck and frets of a fretted musical instrument. The protective sleeve can also be used as a method to impart/control humidity to wood objects that are not fretted musical instruments.

DETAILED DESCRIPTION OF THE DISCLOSURE

Figure 1:
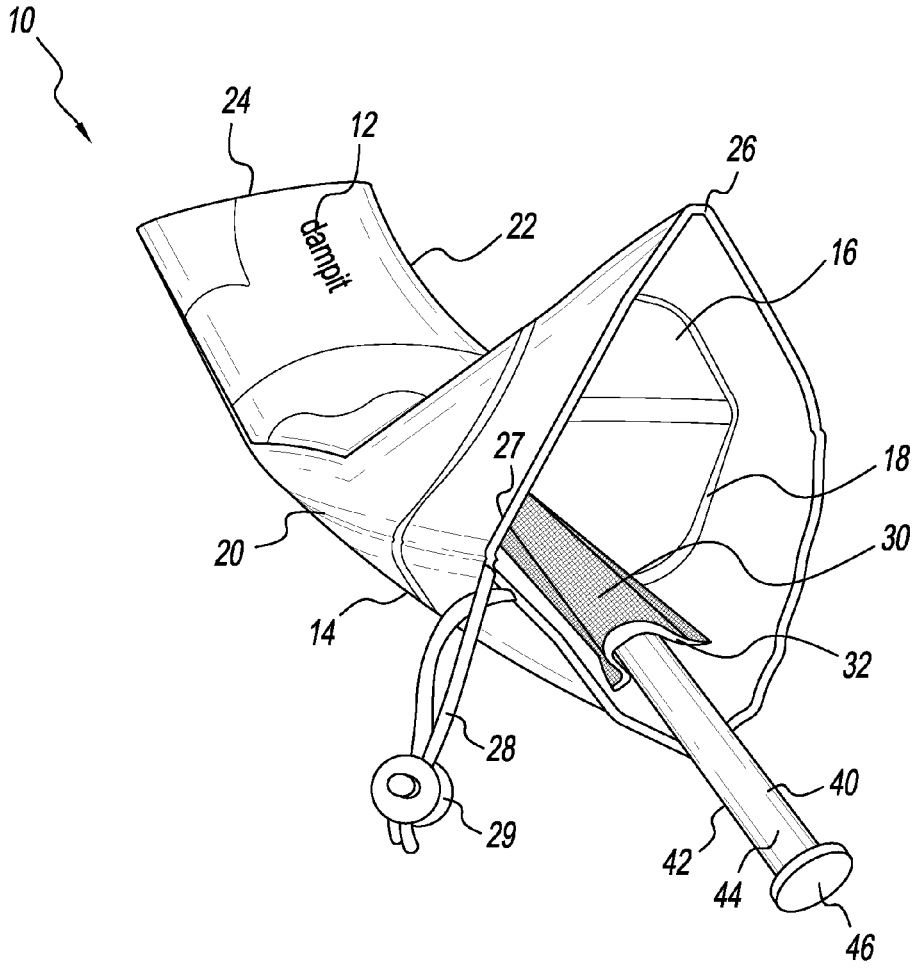
FIG. 1 is a perspective view of an exemplary embodiment of a protective sleeve of the present disclosure, shown in a partially open configuration to reveal a portion of the interior of the sleeve, chute, and closure device (drawstring), and with a humidifying device inserted part-way in the chute.

The present disclosure provides a removable protective sleeve that encloses the stock, neck and frets of a fretted musical instrument. The sleeve is sealed along three sides to form an interior space in the sleeve. The fourth side, at the base of the sleeve, is not sealed and, when opened, can receive the stock and neck of the instrument such that the sleeve completely encloses part or all of the stock and neck of the instrument but does not enclose the body of the instrument. A closure device positioned around the periphery of the open side permits the sleeve to be closed and/or tightened about the base of the neck.

The protective sleeve is made of a material that is impervious to water, and that is partly or completely impervious to water vapor. When placed over the stock and neck of a fretted instrument, the sleeve creates a discrete, enclosed environment in which humidity about the neck can be imparted and controlled by a humidifying device positioned inside the sleeve, regardless of the ambient humidity of the room outside of the protective sleeve.

The protective sleeve has a chute that is connected to an interior aspect of the sleeve. The chute generally has a tubular shape or tunnel shape, and has an opening at one end, or at both ends, into which a humidifying device can be inserted. The chute receives and secures the humidifying device in position inside the protective sleeve.

The chute is made of a vapor-porous material, permitting a humidifying device that is inserted therein to impart humidity and control humidity in the environment enclosed by the protective sleeve about the neck and stock of the instrument. The chute is connected to the protective sleeve in such a way that it automatically orients a humidifying device inserted therein in the correct position so that a sponge inside the humidifying device remains moist, but does not allow any water from leaking out of the humidifying device (once inside the protective sleeve) that would contact the neck, frets or strings of the instrument and cause damage.

The present disclosure can further include a humidifying device that is inserted into the chute. The humidifying device has an exterior substrate that encloses a water-absorbent material, such as a sponge. In an exemplary embodiment, the humidifying device has one or more perforations (holes) through its exterior substrate that permit water to be absorbed by the sponge, and through which excess water is wrung out of the sponge, prior to drying off the exterior material and placing the humidifying device in the chute inside the sleeve. The humidifying device also has a reservoir that holds any remaining water and contains the water inside the humidifying device. The humidifying device of the present disclosure is configured so that the top of the reservoir is positioned to be at least as low as any other portion of the humidifying device when the sleeve is placed over the neck of the instrument, so that gravity helps keep any excess water from leaking out of the humidifying device.

The humidifying device can be adjusted to impart and maintain the desired amount of humidity for the particular type of fretted musical instrument.

The present disclosure further provides a method for using a protective sleeve and humidifying device to enclose, protect, and to impart humidity to, the stock, neck and frets of a fretted musical instrument. The protective sleeve can also be used as a method to impart/control humidity to wood objects that are not fretted musical instruments.

Referring now to the drawings, and in particular, FIG. 1, there is provided a protective sleeve of the present disclosure generally represented by reference numeral 10. Sleeve 10 has a top exterior surface 12 and a bottom exterior surface 14. Sleeve 10 also has a top interior surface 16, and a bottom interior surface 18. Sleeve 10 has two side edges 20, 22 that extend lengthwise to form the sides of the sleeve, and a top edge 24 that extends widthwise to form the top of the sleeve. Each of side edges 20, 22 and top edge 24 are sealed as a closed edge. In the exemplary embodiment in FIG. 1, side edge 20 and top edge 24 are each sealed by sewing the two ends together, and side edge 22 is formed by simply folding the material over onto itself. Alternatively, any of side edges 20, 22 and top edge 24 can be sealed closed by sewing, tape, glue or other adhesive, hook-and-loop fasteners (e.g., VELCRO®), rib-and-groove seals, and any combinations thereof. In a preferred embodiment, side edges 20, 22 are permanently sealed. In an alternative embodiment, one or more of side edges 20, 22 and top edge 24 is reversibly sealed.

Sleeve 10 has a bottom edge 26 that extends widthwise across the extent of the sleeve, but is not sealed. This creates an interior space in sleeve 10 that can receive the stock and neck of a fretted musical instrument 70 (not shown in FIG. 1, but shown in FIGS. 7 and 8) therein. Bottom edge 26 has closure 28 that extends around its periphery and draws bottom edge 26 tightly against the base of the neck of a fretted musical instrument to form an enclosed space or environment. Closure 28 can be, but is not limited to, a draw cord, elastic, tape, hooks, buttons, snaps, hook-and-loop fasteners (e.g., VELCRO®), rib-and-groove seals, and any combinations thereof. As shown in FIG. 1, a preferred embodiment of closure 28 is a draw cord (also called a drawstring without any change in meaning) having a ball lock 29. Also as shown in FIG. 1, bottom edge 26 can be folded over and sealed (in FIG. 1, sealed by sewing) to give a finished appearance to sleeve 10 and to form an interior channel 27 around the base of sleeve 10, in which draw cord 28 is seated.

The diameter of bottom edge 26 is large enough to insert the stock of the fretted musical instrument without difficulty, and the length of sleeve 10 is sufficiently long to allow the entire neck of the instrument to be completely enclosed and shielded inside sleeve 10.

Sleeve 10 has outer dimensions of about twelve (12) inches to about forty (40) inches in length, and about three (3) inches to about ten (10) inches in width; and preferably between about twenty (20) inches to about thirty-two (32) inches in length and about five (5) inches to about seven (7) inches in width. The overall length of sleeve 10 is tailored to the instrument for which it is intended. For example, for most acoustic guitars, a total sleeve length of about twenty-four (24) inches is suitable, and for an electric guitar, about thirty (30) inches is preferred. In the exemplary embodiment shown in FIG. 4, sleeve 10 has outer dimensions of about twenty-five (25) inches in length and about six (6) inches in width.

As noted above, sleeve 10 is made of a material that is impervious to water, and that is partly or completely impervious to water vapor. Preferred materials for sleeve 10 are lightweight, water-resistant or waterproof, and tear-resistant to provide a "raincoat" over the neck of the fretted instrument. Materials used for sleeve 10 include, but are not limited to, nylon, CORDURA® (Invista, Wichita, Kans., U.S.A.), SUPPLEX® (Invista), plastic, treated cotton, pack cloth, neoprene, POLARTEC® (Polartec LLC, Lawrence, Mass., U.S.A.), animal skins (such as leather, sheepskin, goatskin, reptile skin, alligator skin, eel skin, and shark skin), and any combinations thereof. In a preferred embodiment, sleeve 10 is made of 100% nylon. In another preferred embodiment, sleeve 10 is made of animal skin.

When placed over the stock and neck of a fretted instrument, sleeve 10 creates a discrete, enclosed environment in which humidity about the neck can be imparted and controlled by a humidifying device positioned inside the sleeve, regardless of the ambient humidity of the room outside of the protective sleeve.

Sleeve 10 has a chute 30 that is secured to either of top interior surface 16 or bottom interior surface 18. As shown in FIG. 1, chute 30 is secured by sewing to bottom interior surface 18 in a tubular-shaped (or tunnel-shaped) configuration. Chute 30 has a chute bottom 32 that is open, and a top edge (not shown) that is opposite chute bottom 32, and which can be either open or sealed. Chute 30 can also be called an "inner sleeve," "interior sleeve," "second sleeve" and "pocket" in this application.

The size of the tubular-shaped or tunnel-shaped opening of chute 30 can be tailored to the diameter of a humidifying device 40 that is inserted into chute 30 at chute bottom 32. In the exemplary embodiment in FIG. 1, humidifying device 40 is a DAMPITS® humidifying device that is shown when inserted part-way in chute 30. In a preferred embodiment, humidifying device 40 is inserted further in chute 30, so that only lower grommet 46 of humidifying device 40 remains outside of the chute. Chute 30 is secured to the interior of sleeve 10 to form an opening that is substantially a half-circle, which can firmly secure humidifying device 40 having a substantially circular cross-section. Humidifying device 40 can have an exterior substrate that is soft, flexible, and/or rubbery that provides additional frictional force that holds humidifying device 40 in position inside of chute 30.

As shown in FIG. 1, sleeve 10 has one chute 30. However, in other exemplary embodiments, sleeve 10 can have two or more chutes 30; e.g., two chutes 30, three chutes 30, four chutes 30, five chutes 30, or six chutes 30. Chutes 30 can be of different diameters and lengths to accommodate humidifying devices 40 of various sizes. Chute 30 can be made of a material that is color-coded to indicate that it can receive humidifying device 40 that is small, medium or large.

Chute 30 is made of a porous material that is gas-permeable, e.g., permeable to water vapor (humidity or moisture). Chute 30 can also be liquid-permeable. Materials used for chute 30 include, but are not limited to, nylon. Chute 30 is preferably made of a material that is flexible which will stretch a little to permit easy insertion of humidifying device 40, but will return to its original configuration to tightly secure humidifying device 40 inside sleeve 10. In a preferred embodiment of this disclosure, the chute is a porous nylon material, which is permeable to water vapor (humidity).

In an exemplary embodiment, chute 30 is connected to sleeve 10 to form a half-circular diameter from about three-eighths (3/8) of an inch to about one (1) inch diameter, and preferably between about five-eighths (5/8) of an inch. The diameter can be tailored to the particular type of musical instrument for which the sleeve is likely to be used.

Chute 30 is positioned about one-half (1/2) inch inside of channel 27 that houses draw cord 28. This position correctly places humidifying device 40 in relation to the neck of the fretted instrument.

Humidifying device 40 is inserted into chute 30. Humidifying device 40 has an exterior substrate that encloses a water-absorbent material (not shown), such as a sponge. The exterior substrate of humidifying device 40 has one or more perforations 42 that permit water to be absorbed by the sponge prior to insertion in chute 30. Excess water is wrung out of the sponge through perforations 42 and the exterior substrate of humidifying device 40 is dried off before inserting humidifying device 40 in chute 30. This reduces or eliminates any remaining water drops that might otherwise contact the neck of the musical instrument when sleeve 10 is placed thereon.

Humidifying device 40 has a reservoir 44 that holds any water inside the humidifying device and prevents any water droplets from leaking outside. Lower grommet 46 is positioned at the end of reservoir 44, and seals the lower end of humidifying device 40. The other end of humidifying device 40 is sealed by an upper grommet (not shown). Lower grommet 46 is preferably larger than the upper grommet, so that humidifying device 40 slides easily into chute 30, up to the point where lower grommet 46 is at chute bottom 32. The top of reservoir 44 is positioned to be at least as low as any other portion of the humidifying device when sleeve 10 is placed over the neck of the musical instrument, so that gravity assists in keeping any excess water from leaking out of humidifying device 40.

Figure 2:
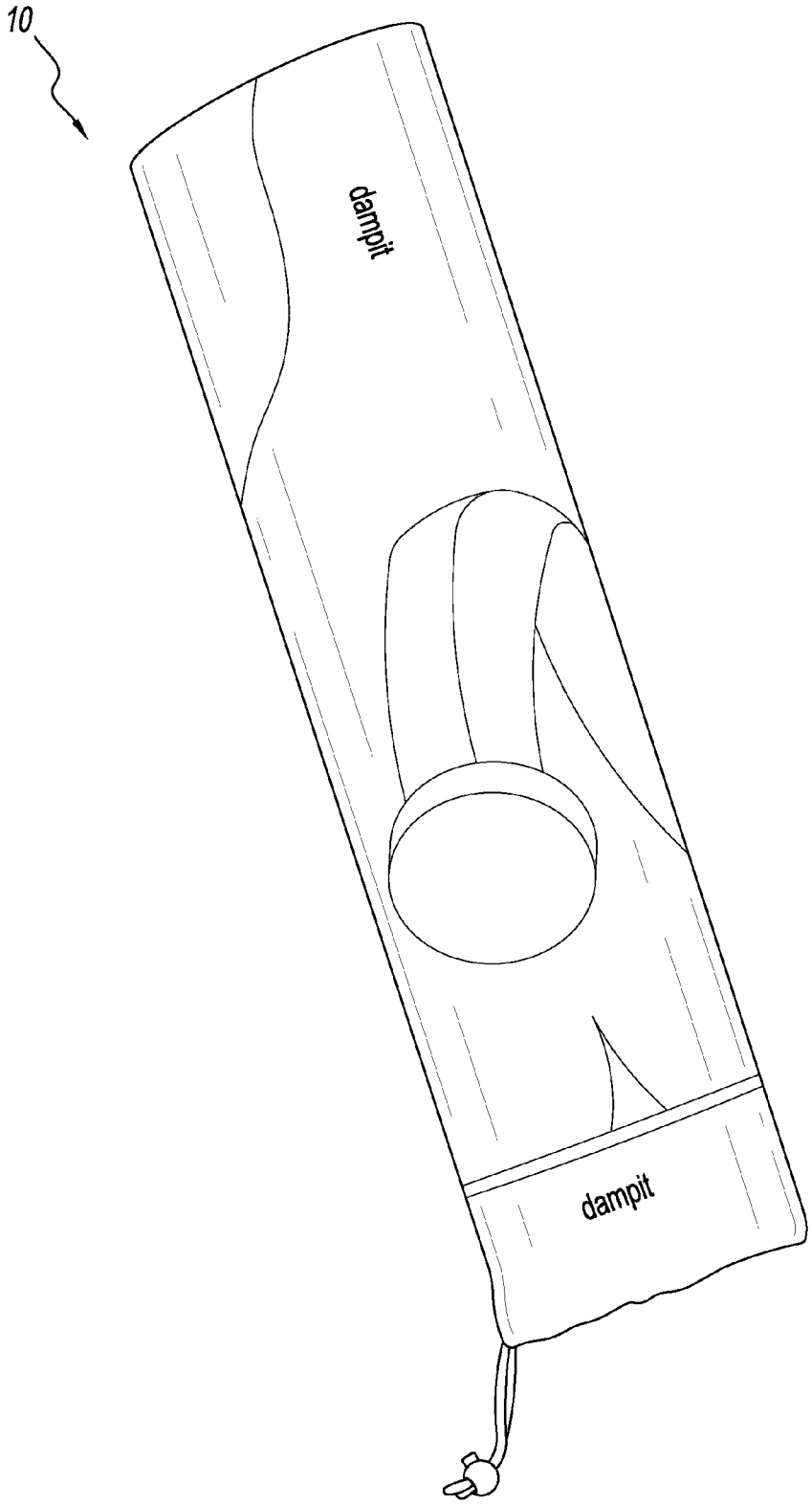
FIG. 2 is a top side view of the protective sleeve in FIG. 1, having a rounded top.
Figure 3:
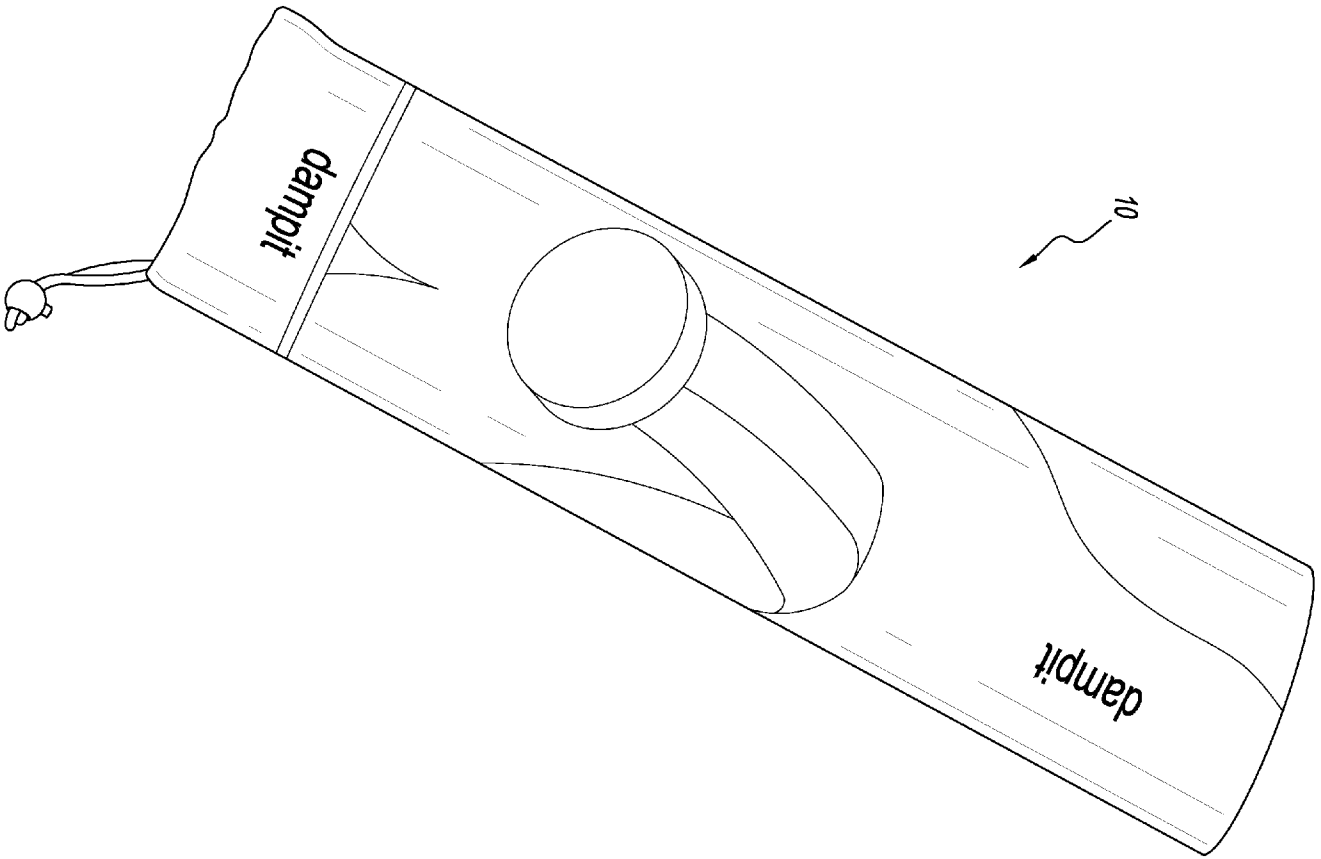
FIG. 3 is a bottom side view of the protective sleeve in FIG. 1.

Referring now to FIGS. 2 and 3, a top view and bottom view, respectively, of sleeve 10 are shown. In these embodiments, the top edge is gently rounded for a more finished appearance and better fit about to the stock and neck of the musical instrument.

Figure 4:
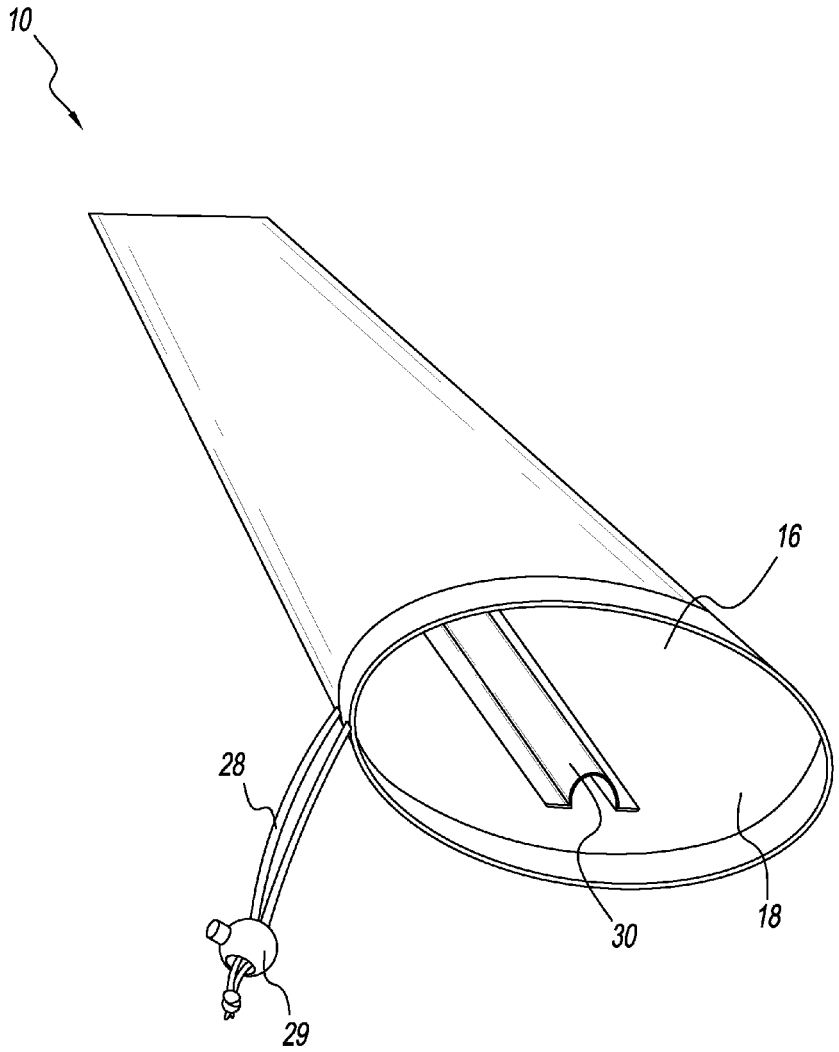
FIG. 4 is a perspective view of an exemplary embodiment of the protective sleeve of the present disclosure, shown partially open to reveal the interior of the sleeve, chute, and closure device (draw cord).

FIG. 4 is another exemplary embodiment of sleeve 10, shown partially open at the bottom edge to reveal the interior surfaces 16, 18 of sleeve 10, a chute 30, and a closure device (draw cord 28 with ball stop 29).

Figure 5:
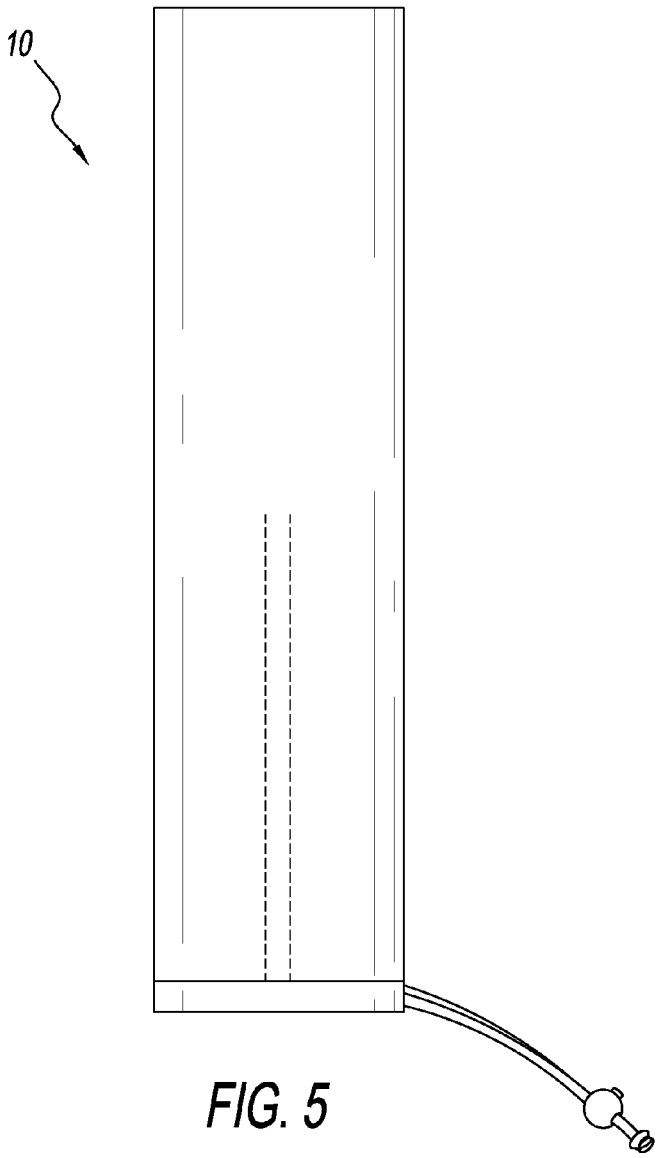
FIG. 5 is a top view of another exemplary embodiment of the protective sleeve of the present disclosure.
Figure 6:
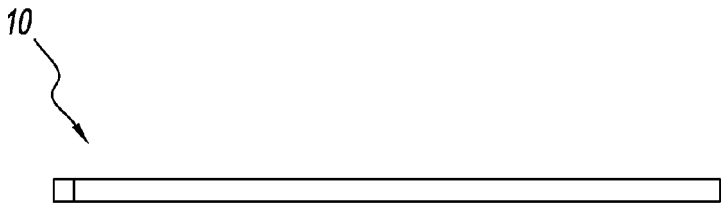
FIG. 6 is a right side view of the protective sleeve in FIG. 5.

FIGS. 5 and 6 provide two views of another exemplary embodiment of sleeve 10.

Figure 7:
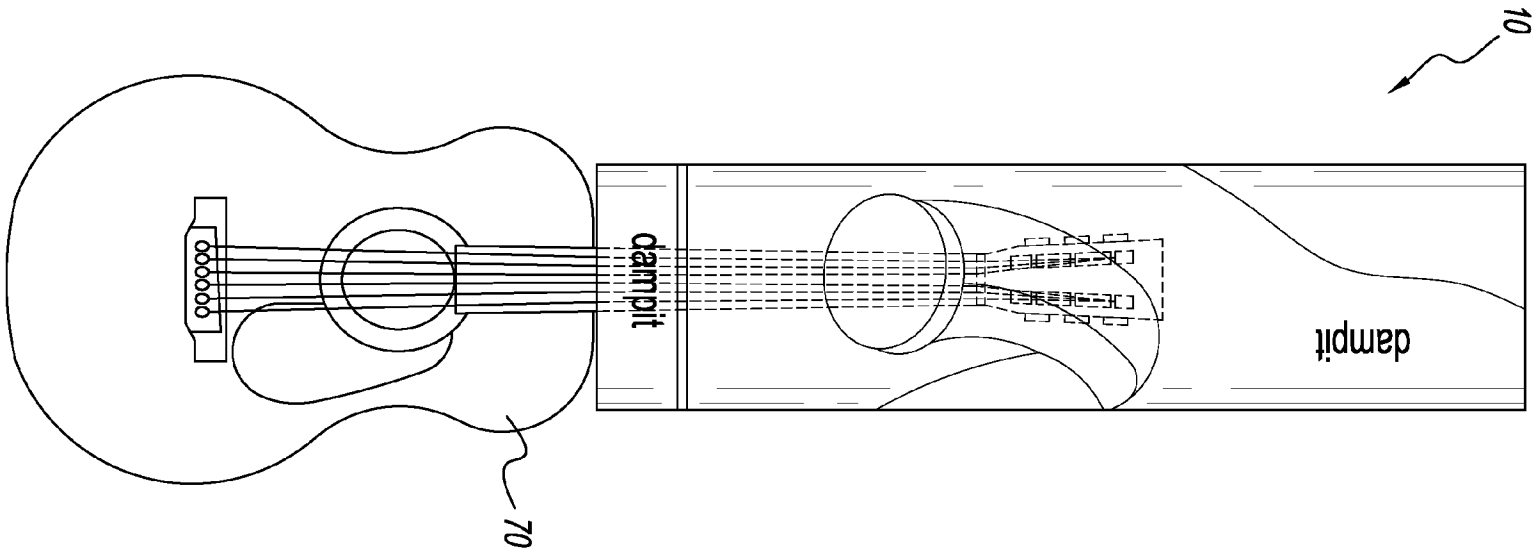
FIG. 7 is a schematic showing a top view of an exemplary embodiment of a protective sleeve of the present disclosure that has been pulled over to enclose the neck of an acoustic guitar, before the open side at the base of the sleeve is closed around the neck, and shown as partially transparent to reveal how the guitar stock and neck are received in the protective sleeve (in most embodiments, the protective sleeve is largely opaque and would cover the guitar neck therein).
Figure 8:
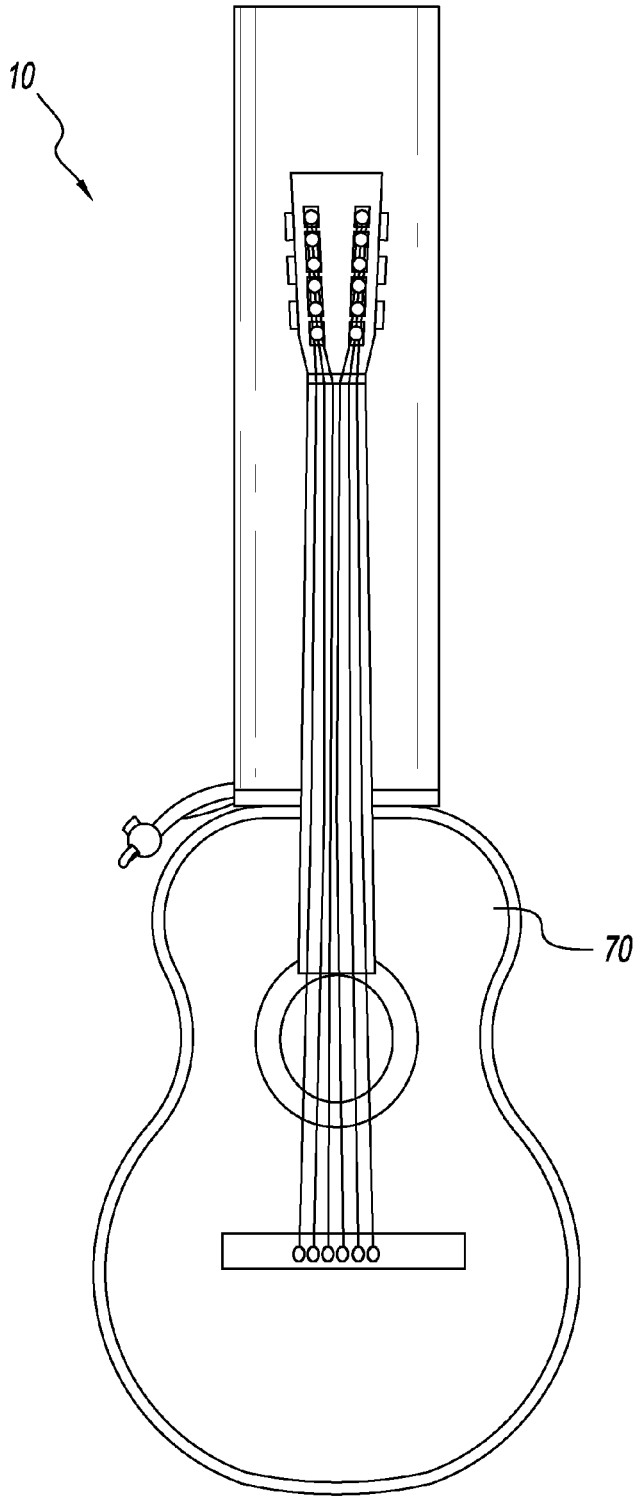
FIG. 8 is a top view of another embodiment of the protective sleeve of the present disclosure, showing the protective sleeve over the stock, neck and frets of an acoustic guitar, before the drawstring at the base of the sleeve is closed around the neck.

FIGS. 7 and 8 are illustrations that show how the neck of an acoustic guitar is received in sleeve 10. In use, the neck of the guitar would be shielded inside sleeve 10, and not visible from the exterior as in FIGS. 7 and 8. These views are provided to show the relation of the neck within sleeve 10.

The present disclosure also provides a method of using sleeve 10 to protect and humidify the neck of a fretted musical instrument. In an exemplary embodiment, the method includes the steps of contacting or submerging a humidifying device in water until a water-retaining material inside the humidifying device is fully saturated, which can be between about 30 to about 60 seconds. The humidifying device is then wrung out of any excess water (such as by pressing or twisting the humidifying device), and the exterior surface of the humidifying device is dried off with a small cloth, towel, or paper towel to remove any water droplets thereon. The humidifying device is then inserted into a chute that is secured inside the sleeve. The sleeve is then pulled over or around the neck of the instrument, preferably so that the humidifying device is positioned behind the neck of the instrument and away from the instrument's vibrating strings. The closure device (e.g., a draw cord) at the base of the sleeve is then drawn tightly about the neck of the instrument, thereby enclosing the neck of the instrument and forming a closed environment inside the sleeve. Since the sleeve is largely gas-impermeable, the environment enclosed by the sleeve is separate from, and can be regulated to have a different humidity level than, the ambient environment (i.e., in the open air, or inside an instrument case). Additional humidifying devices may be inserted into other chutes in the sleeve to further control and regulate the humidity levels inside the sleeve.

As a further option to improve the seal of the sleeve about the neck of the musical (fretted) instrument, the present disclosure also may include an inflatable collar, or a piece of foam connected to the inner aspect of the sleeve, that more tightly encloses and seals the sleeve about the neck or tailpiece of the musical instrument. This may further reduce any loss or leakage of humidity from the environment created inside the sleeve when placed over the neck of the instrument.

The structure and materials of the sleeve of the present disclosure, and its method of use, provide a significant benefit for humidifying a neck of a fretted instrument, as compared with placing a humidifying device with a fretted musical instrument inside a conventional padded "gig bag" (or other instrument cover). The present sleeve holds the humidifying device in the proper orientation, and in the optimal position in relation to the neck and fingerboard of the instrument so that nearly all of the humidity generated by the humidifying device is available to the musical instrument, and little is absorbed by the sleeve or lost by escaping the sleeve. This permits the number (and sizes) of the one or more humidifying device(s) positioned in chutes in the sleeves to be carefully and accurately scaled by the player to the type of instrument and the current wood moisture content in the neck. A humidity monitoring sensor (not shown) can be used to accurately and predictably control humidity in the local environment in the sleeve. By contrast, the cotton padding in the gig bag or instrument cover can absorbs some or all of the humidity that was intended for the instrument, which not only leads to unpredictability as to how many (and what size) of humidifying devices to use for a particular instrument, but can damage the gig bag as well.

Although the embodiments of the present method describe the use of the sleeve to protect and humidify the neck of a musical instrument, the method also contemplates use of the sleeve to protect and humidify structures that are not musical instruments. Examples of these other applications include, but are not limited to, humidifying antique furniture, wood objects, cigars, food, old documents and books, paintings, and any fibrous object.

In another embodiment (not shown), the protective sleeve extends beyond the base of the neck to also cover that portion of the fingerboard (e.g., at fret 12 and higher, or fret 15 and higher) that is positioned on the top of the instrument body. In these embodiments, the sleeve extends over the stock and neck, and over a portion of the body to reach the level where the body of the fretted musical instrument curves inward, where the sleeve is held in position by means of elastic or a draw cord to create a sealed environment.

In yet another embodiment of the present disclosure, the sleeve completely encompasses the entire fretted musical instrument, providing an environment about the entire instrument in which humidity can be controlled and that is largely separate from the ambient environment.

The word "about," as used herein for dimensions, weights, weight-percentages, or measures of absorbency, means a range that is ±10% of the stated value, more preferably ±5% of the stated value, and most preferably +1% of the stated value, including all subranges therebetween.

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances that fall within the scope of the disclosure.

What is claimed is:

1. A sleeve for a fretted musical instrument having a neck portion and a stock, comprising:

a sleeve for positioning about the neck portion of the fretted musical instrument, the sleeve comprising:

a top side;

two longitudinal sides;

a bottom side having a bottom edge with an opening; and a closing device positioned at the bottom edge, wherein the top side and the two longitudinal sides of the sleeve are closed, and the bottom side is open to receive the neck portion of the fretted musical instrument in the sleeve, and a chute connected to an interior portion of the sleeve, the chute comprising:

a first end, the first end having an first end opening; and a second end opposite to the first end, wherein the chute is made of a material that is permeable to water vapor, and wherein the closing device can be tightened about the neck portion of the fretted musical instrument to form a discrete environment inside the sleeve.

2. The sleeve according to claim 1, wherein the sleeve is made of a material that is impermeable to water and to water vapor.

3. The sleeve according to claim 1, wherein the chute is formed in a tunnel configuration.

4. The sleeve according to claim 1, wherein the chute is a plurality of chutes.

5. The sleeve according to claim 1, wherein the chute is oriented in the interior portion of the sleeve to be behind the neck of the fretted musical instrument when the sleeve is placed over the neck.

6. The sleeve according to claim 1, wherein the opening at the bottom edge is a size that allows the stock and the neck portion of the fretted musical instrument to be inserted in the sleeve, and removed therefrom.

7. The sleeve according to claim 1, wherein the closing device is a closure selected from the group consisting of one or more: draw cord, elastic, tape, hook, button, snap, hook-and-loop fastener, rib-and-groove seal, and any combinations thereof.

8. The sleeve according to claim 1, wherein the sleeve is a barrier that encloses and protects the neck of the fretted musical instrument when the sleeve is placed over the neck of the fretted musical instrument.

9. The sleeve according to claim 1, further comprising:

a humidifying device disposed in the sleeve, wherein the humidifying device is received and secured in position in the sleeve by the chute.

10. The sleeve according to claim 9, wherein the humidifying device is inserted in the first end opening of the chute.

11. The sleeve according to claim 10, wherein the chute orients and maintains the humidifying device inserted therein in a correct position in the sleeve so that the water-absorbent device remains moist but does not leak any water out of the humidifying device.

12. The sleeve according to claim 9, wherein the humidifying device has an exterior substrate that encloses a water-absorbent material.

13. The sleeve according to claim 12, wherein the water-absorbent material is a sponge.

14. The sleeve according to claim 12, wherein the exterior substrate comprises one or more perforations therethrough, wherein the one or more perforations provide an opening through which water is absorbed by the water-absorbent material, and an opening through which a portion of the water is wrung out of the water-absorbent material prior to placing the humidifying device in the sleeve.

15. The sleeve according to claim 12, wherein the humidifying device further comprises:

a reservoir that is enclosed by a portion of the exterior substrate, wherein the portion of the exterior substrate enclosing the reservoir has no perforations therethrough, and wherein the reservoir holds another portion of the water that is not absorbed by or wrung out of the water-absorbent material inside the humidifying device and contains the water therein.

16. The sleeve according to claim 15, wherein the reservoir is configured so that a top of the reservoir is at least as low as any other portion of the humidifying device when the sleeve is placed over the neck of the fretted musical instrument.

17. The sleeve according to claim 9, wherein the humidifying device generates water vapor in the discrete environment formed inside the sleeve to increase the humidity level therein.

18. The sleeve according to claim 17, wherein the humidity level in the discrete environment formed inside the sleeve is different than an ambient humidity level in the environment outside the sleeve.

19. The sleeve according to claim 9, wherein the humidifying device is a plurality of humidifying devices.

20. The sleeve according to claim 19, wherein the plurality of humidifying devices have a predetermined number thereof that are present inside of the sleeve to impart a predetermined humidity level in the discrete environment in the sleeve.

21. A method of using a sleeve having a humidifying device therein to impart humidity to a neck of a fretted musical instrument, comprising:

contacting the humidifying device with water to saturate a water-absorbent material inside the humidifying device;

wringing out the humidifying device to remove an excess portion of water from the water-absorbent material, but leaving a portion of water contained in a reservoir in the humidifying device;

drying an exterior surface of the humidifying device to remove any water droplets;

inserting the humidifying device in a chute that is connected to an interior portion of the sleeve;

pulling the sleeve over the neck of the fretted musical instrument to enclose the neck in the sleeve; and tightening a closing device at a bottom edge of the sleeve about the neck of the fretted musical instrument to enclose the neck and form a discrete environment inside the sleeve, wherein the humidifying device generates water vapor in the discrete environment inside the sleeve to increase the humidity level therein to a predetermined humidity level.

22. The method according to claim 21, further comprising inserting two or more humidifying devices in chutes in the sleeve, wherein the two or more humidifying devices generate a predetermined humidity level in the discrete environment formed in the sleeve.

23. The method according to claim 21, wherein the sleeve is pulled over the neck so that the chute and the humidifying device inserted therein are positioned behind the neck of the fretted instrument.

24. The method according to claim 21, wherein the humidifying device further comprises a reservoir, and wherein the humidifying device is inserted in the chute to be oriented with a top of the reservoir that is at least as low as any other portion of the humidifying device when the sleeve is pulled over the neck of the fretted musical instrument, so that gravity prevents water in the reservoir from leaking out of the humidifying device.

* * * * *